US005515154A

United States Patent [19]

Hasegawa et al.

[11] Patent Number: 5,515,154

[45] Date of Patent: May 7, 1996

[54] COLOR IMAGE FORMING APPARATUS

[75] Inventors: Takashi Hasegawa, Ageo; Akihito Hosaka; Masahiro Inoue, both of Yokohama, all of Japan

[73] Assignee: Canon Kabushiki Kaisha, Tokyo, Japan

[21] Appl. No.: 111,467

[22] Filed: Aug. 25, 1993

[30] Foreign Application Priority Data

Aug. 28, 1992 [JP] Japan ..... 4-254078

[51] Int. Cl.[6] ..... G03G 15/01; G03G 15/14

[52] U.S. Cl. ..... 355/326 R; 355/273; 355/327

[58] Field of Search ..... 355/326 R, 327, 355/273, 277, 210

[56] References Cited

U.S. PATENT DOCUMENTS

| | | | |
|---|---|---|---|
| 4,110,031 | 8/1978 | Ebi et al. | 355/327 X |
| 4,723,145 | 2/1988 | Takada et al. | 355/326 X |
| 4,766,463 | 8/1988 | Watanuki et al. | 355/326 X |
| 4,788,574 | 11/1988 | Matsumoto et al. . | |
| 4,862,214 | 8/1989 | Kasahara et al. | 355/277 |
| 4,875,069 | 10/1989 | Takada et al. . | |
| 5,083,167 | 1/1992 | Fukushima et al. . | |
| 5,159,393 | 10/1992 | Hiroshima et al. . | |
| 5,187,536 | 2/1993 | Hasegawa et al. . | |

FOREIGN PATENT DOCUMENTS

| | | |
|---|---|---|
| 59-32792B2 | 10/1984 | Japan . |
| 1-40972 | 2/1989 | Japan . |
| 3-148680 | 6/1991 | Japan . |
| 5-35044 | 2/1993 | Japan . |

*Primary Examiner*—Nestor R. Ramirez

*Attorney, Agent, or Firm*—Fitzpatrick, Cella, Harper & Scinto

[57] ABSTRACT

The present invention provides a color image forming apparatus for forming a color image by superimposing a plurality of color toner images on a recording material, which can improve the quality of the toner images on the recording material during the transferring of the plural color toner images.

The present invention slightly differentiates a moving speed of an electrophotographic photosensitive member as an image bearing member from a moving speed of a recording material bearing means which supports the recording material and moves with respect to the photosensitive member. Whereby, it is possible to adequately transfer the toner images onto the recording material in a superimposed fashion.

28 Claims, 6 Drawing Sheets

COLOR IMAGE FORMING APPARATUS

BACKGROUND OF THE INVENTION

1. Field of the Invention

The present invention generally relates to an image forming apparatus of electrophotographic type or electrostatic recording type wherein a visualized image is formed on an image bearing member and the visualized image is transferred onto a recording material carried by a recording material bearing means. More particularly, the present invention relates to a color image forming apparatus wherein a recording material is electrostatically adhered to a recording material bearing means such as a recording material bearing sheet and visualized color images (toner images) formed on image bearing member(s) are transferred onto the recording material in a superimposed fashion by applying the electric field to the recording material, thereby obtaining a full-color image.

2. Related Background Art

There have been proposed various image forming apparatuses (so-colled color image forming apparatuses) wherein visualized images (toner images) of different colors are formed on image bearing member(s) and the toner images are successively transferred onto a single recording material in a superimposed fashion. Among them, color image forming apparatuses of electrophotographic type have been used most widely. Such color image forming apparatuses of electrophotographic type can generally be divided into a first group wherein toner images of different colors are successively formed on a single photosensitive drum as an image bearing member and the toner images are successively transferred onto a recording material carried and conveyed by a transfer drum as a recording material bearing means in a superimposed fashion and the transferred images are fixed together to obtain a color image, and a second group wherein a plurality (generally, four) of image forming stations are arranged side by side and toner images of different colors are formed on the respective photosensitive drums individually and the toner images are successively transferred onto a recording material carried and conveyed by a recording material bearing belt such as a dielectric belt in a superimposed fashion and the transferred images are fixed together to obtain a color image.

In such color image forming apparatuses of electrophotographic type, the photosensitive drum and the transfer drum or the recording material bearing belt are normally rotated at the same speed while they are contacted with each other. FIG. 6 is a schematic view for showing the above-mentioned first group wherein the single photosensitive drum and the transfer drum are used and for explaining a driving condition of the photosensitive drum and the transfer drum. The photosensitive drum 3 is rotated in a direction shown by the arrow at an angular velocity of $\omega_1$. Further, the rotational force of the photosensitive drum 3 is transmitted to the transfer drum 9 via a gear 91 meshed with a gear 31 of the photosensitive drum 3 so that the transfer drum is rotated in a direction shown by the arrow at an angular velocity of $\omega_2$. Now, it is assumed that a peripheral speed of the photosensitive drum 3 is $V_1$, a radius of the photosensitive drum is $r_1$, the number of teeth of the photosensitive drum gear 31 is $N_1$, a radius of a pitch circle of this gear is $D_1$, a peripheral speed of the transfer drum 9 is $V_2$, a radius of the transfer drum is $r_2$, the number of teeth of the transfer drum gear 91 is $N_2$, and a radius of a pitch circle of this gear is $D_2$.

Normally, in an image forming apparatus, it is so designed that the radius $r_1$ of the photosensitive drum 3 becomes greater than the radius $r_2$ of the transfer drum 9 by integral number times or vice versa, in consideration of the discrepancy in color during the formation of the full-color image (for example, refer to the Japanese Patent Publication No. 59-32792). That is to say, in the conventional image forming apparatuses, the following relations are established between the photosensitive drum 3 and the transfer drum 9:

$$r_1=k\cdot r_2(k=\ldots, 1/4, 1/3, 1/2, 1, 2, 3, 4, \ldots);$$

$$D_1=r_1,\ D_2=r_2;$$

$$\omega_1=1/k\cdot\omega_2;$$

$$N_1=k\cdot N_2;$$

$$V_1=V_2.$$

However, in such conventional image forming apparatus, during the transferring of the toner images, particularly when the image is a line image such as a character, there arose a problem that the so-called "void" phenomenon in which a central portion of the character except for edge portions of the character cannot be transferred occurs.

Next, the occurrence of the void phenomenon will be explained with reference to FIGS. 7A to 7E.

FIG. 7A shows a portion of the line image in which the void phenomenon occurs (i.e., a central portion of the image (except for edge portions) is not transferred), and FIG. 7B shows a section of the toner line image L formed on the photosensitive drum 3 by the development. As shown in FIG. 7C, the recording material P carried by a recording material bearing sheet S of the transfer drum 9 is contacted with the toner line image L at a transfer station. In this case, due to the resilience of the recording material bearing sheet S, the resilience of the recording material P itself, an urging force of a transfer urging member (not shown) and the electrostatic attraction force between the recording material P and the photosensitive drum 3, the pressure is applied to the toner image L in a direction shown by the arrow. Consequently, as shown in FIG. 7D, since a central portion 1 of the toner image L is subjected to the partial pressure greater than those acting on both side portions (edge portions) 2, the cohesion between the toner particles is increased. Thus, when the recording material P is separated from the photosensitive drum 3, the toner existing on the surface of the photosensitive drum still remains on the drum surface due to the Fandelwarles' force. In this case, since the cohesion of the toner in the central portion 1 of the toner image L is strong, the toner of the central portion remains on the drum surface. As a result, as shown in FIG. 7E, only the edge portions 2 of the toner line image L are transferred onto the recording material P, with the result that the void phenomenon as shown in FIG. 7A occurs.

In order to avoid the void phenomenon, in an image forming apparatus wherein a conventional transfer roller is used to pinch a recording material between it and a photosensitive drum and to convey the recording material as disclosed in U.S. Pat. No. 5,159,393, it is considered that a speed of the transfer drum is differentiated from that of the photosensitive drum.

However, in an image forming method wherein toner images are successively transferred onto a recording material in a superimposed fashion, when the conveying mechanism comprising the nip between the photosensitive drum and the transfer roller is used, the moving speed of the recording material is not uniform because of the slip of the recording material in the nip. As a result, for example, due to the local excessive slip, there arises a problem regarding the synchronism between the toner images, thereby worsening the quality of the color image.

SUMMARY OF THE INVENTION

An object of the present invention is to provide an image forming apparatus which can prevent the void phenomenon during the transferring of visualized images and obtain an output image with high accuracy and high quality without fail.

Another object of the present invention is to prevent the void phenomenon while toner images are transferred onto a recording material in a superimposed fashion and to improve the quality of a color image.

To achieve the above object, according to the present invention, there is provided a color image forming apparatus for forming a color image by superimposing a plurality of color toners, comprising a toner image forming means for forming a toner image on an image bearing member moving along an endless path, a recording material bearing means which moves along an endless path to support a recording material and to convey the recording material to a transfer station, a transfer means for transferring the toner image formed on the image bearing member onto the recording material supported by the recording material bearing means at the transfer station, and a drive means having a drive system for slightly differentiating a moving speed of the image bearing member from a moving speed of the recording material bearing means.

The image bearing member to which the present invention can be applied may be an electrophotographic photosensitive member, or may be an intermediate transfer member to which the toner image formed on such photosensitive member is temporarily transferred before the toner image is transferred onto the recording material.

Further, as an example of a relation between the image bearing member and the recording material bearing means according to the present invention, a single image bearing member may be opposed to a single recording material bearing means, or a plurality of image bearing members may be opposed to a single recording material bearing means.

Furthermore, regarding configurations of the image bearing member and the recording material bearing means, a drum shape or a belt shape may be applied, and the apparatus according to the present invention is constituted by combining such image bearing member and the recording material bearing means having such configurations.

DESCRIPTION OF THE PREFERRED EMBODIMENTS

The present invention will now be explained in connection with embodiments thereof with reference to the accompanying drawings. Incidentally, in embodiments described below, although examples that the present invention is applied to a color image forming apparatus of electrophotographic type will be explained, it should be noted that the present invention can be applied to image various image forming apparatuses of electrophotographic type other than the embodiments or of electrostatic recording type.

First of all, a first embodiment of the present invention will be explained with reference to FIGS. 1 and 2.

Figure 1:
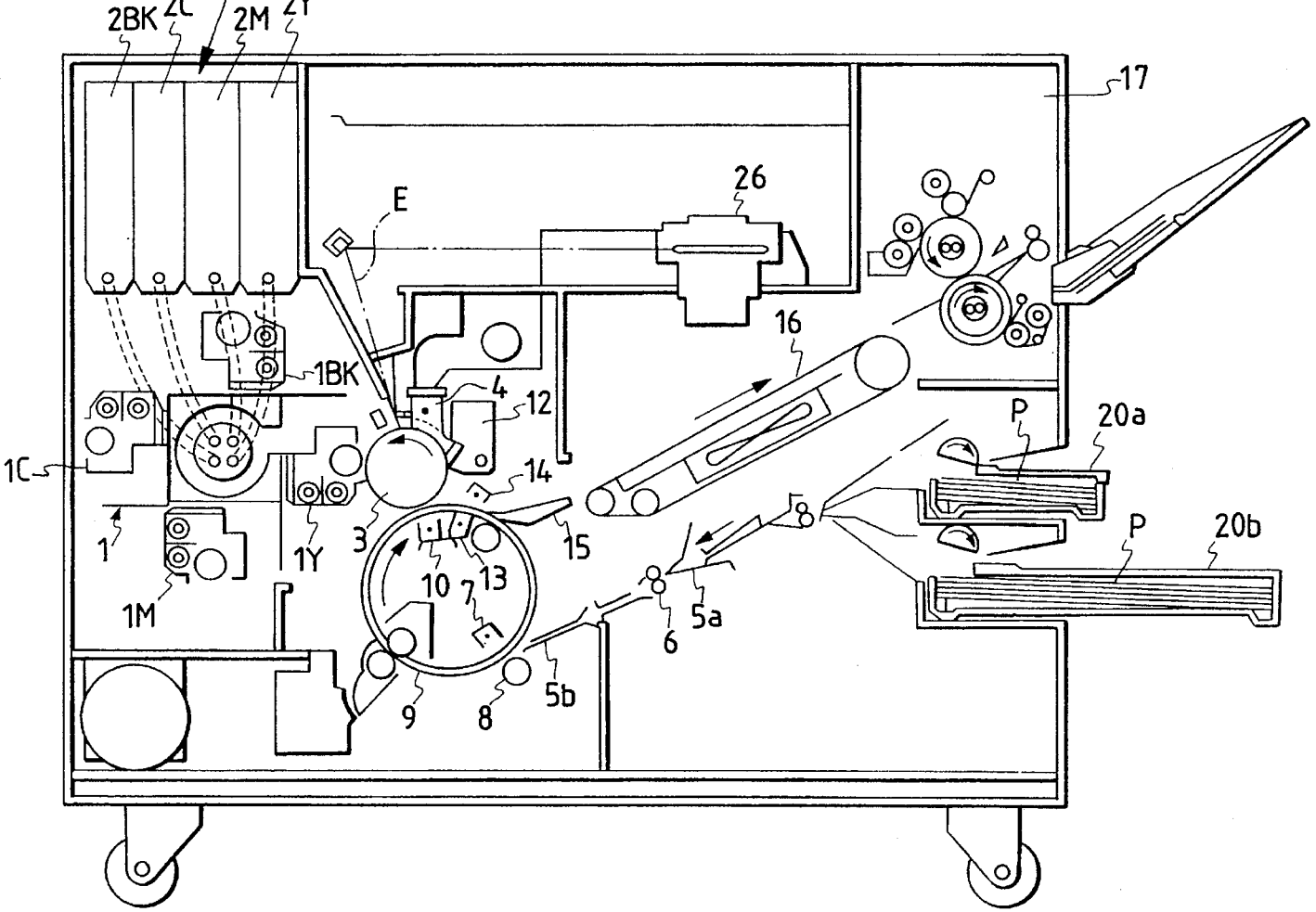
FIG. 1 is a schematic sectional view showing a whole construction of a color image forming apparatus of electrophotographic type according to a first embodiment of the present invention.

FIG. 1 is a schematic sectional view for showing a whole construction of a color image forming apparatus of electrophotographic type to which the present invention is applied, in which visualized images (toner images) having different colors are successively formed on a single electrophotographic photosensitive drum and the toner images are successively transferred onto a recording material carried and conveyed by a transfer drum in a superimposed fashion and the superimposed non-fixed toner images are fixed together to obtain a color image.

This color image forming apparatus is a color laser beam printer of electrophotographic type having a developing device comprising a so-called rotary developing device, and includes a photosensitive drum (image bearing member) 3 which is rotatably supported and is rotated in an anticlockwise direction shown by the arrow. An image forming means is arranged around the photosensitive drum. In the illustrated embodiment, the image forming apparatus comprises a charger 4 for uniformly charging the photosensitive drum 3, an exposure means 26 (for example, comprising a laser beam exposure device) for emitting a color-decomposed light image or an equivalent light image E to form an electrostatic latent image on the photosensitive drum 3, and a rotary developing means 1 for visualizing the electrostatic latent image on the photosensitive drum 3 with color toner.

The rotary developing means 1 comprises four developing devices 1Y, 1M, 1C, 1BK containing, for example, yellow developer, magenta developer, cyan developer and black developer, respectively, and a substantially cylindrical frame for holding the four developing devices 1Y, 1M, 1C and 1BK, which frame is rotatably supported.

The rotary developing means 1 is designed so that a desired developing device can be brought, by the rotation of the frame, into a developing station where the desired developing device is opposed to a peripheral surface of the photosensitive drum 3 and where the electrostatic latent image on the photosensitive drum is developed and so that the development for forming a four-full-color image can be effected during one revolution of the frame. Further, a developer (toner) replenishing device 2 has four hoppers 2Y, 2M, 2C and 2BK containing yellow developer, magenta developer, cyan developer and black developer, respectively, so that any developer can be replenished into the corresponding developing device at need.

Next, the whole operation of the color image forming apparatus will be briefly explained with reference to a full color mode, for example. First of all, the photosensitive drum 3 is uniformly charged by the charger 4. Then, the image exposure is effected by the laser light E modulated by an yellow image signal of an original (not shown), thereby forming the electrostatic latent image on the photosensitive drum 3. This electrostatic latent image is developed by the yellow developing device 1Y which has been positioned at the developing station, thereby forming the yellow visualized image.

On the other hand, a recording material P supplied from a recording material cassette 20*a* or 20*b* via a sheet supply guide 5*a*, a sheet supply roller 6 and a sheet supply guide 5*b* is subjected to the adsorption charge by an adsorption charger 7 in synchronous with the predetermined timing and is electrostatically wound around a transfer drum (recording material bearing means) 9 by the adsorption charger 7 and an abutment roller (counter-electrode) 8. As disclosed in U.S. Pat. No. 4,875,069, the transfer drum 9 comprises a cylinder having an opening formed in the peripheral surface of the cylinder, and a film-shaped dielectric sheet covering the opening.

Although the film-shaped dielectric sheet may be preferably made of polyethylene terephthalate resin, polyvinylidene fluoride resin, polyurethane resin, polycarbonate resin or polyether sulfonic resin, in the illustrated embodiment, the sheet was made of polyvinylidene fluoride resin (having a thickness of 150 μm). Further, the abutment roller 8 is directly earthed or is connected to an appropriate bias power source or is earthed via a resistor.

The transfer drum 9 is rotated in a direction shown by the arrow in synchronous with the photosensitive drum 3, so that the toner image developed by the yellow developing device 1Y is transferred onto the recording material P by a transfer charger 10 at a transfer station. The transfer drum 9 continues to rotate for preparation for the transferring of the next toner image (magenta toner image in FIG. 1).

The charge is removed from the photosensitive drum 3 and then the photosensitive drum is cleaned by a cleaning member 12. Then, the photosensitive drum is uniformly charged by the charger 4 again, and the exposure is effected by a magenta image signal in the same manner as mentioned above. Meanwhile, the developing means is rotated by one revolution so that the magenta developing device 1M is positioned at the developing station. Thus, the development with magenta developer can be effected. Subsequently, the same sequences are repeated regarding the cyan color and black color. After four color toner images are transferred, the charges on the four superimposed color toner images on the recording material are removed by charge removing chargers 13, 14. Then, the recording material is separated from the transfer drum 9 by a separating pawl 15 and then is sent, by a convey belt 16, to a fixing device (heat roller fixing device) 17 where the superimposed toner images are fixed together. Thereafter, the recording sheet is discharged out of the apparatus. In this way, a series of full-color printing operations are finished and a desired full-color print image is outputted.

Figure 2:
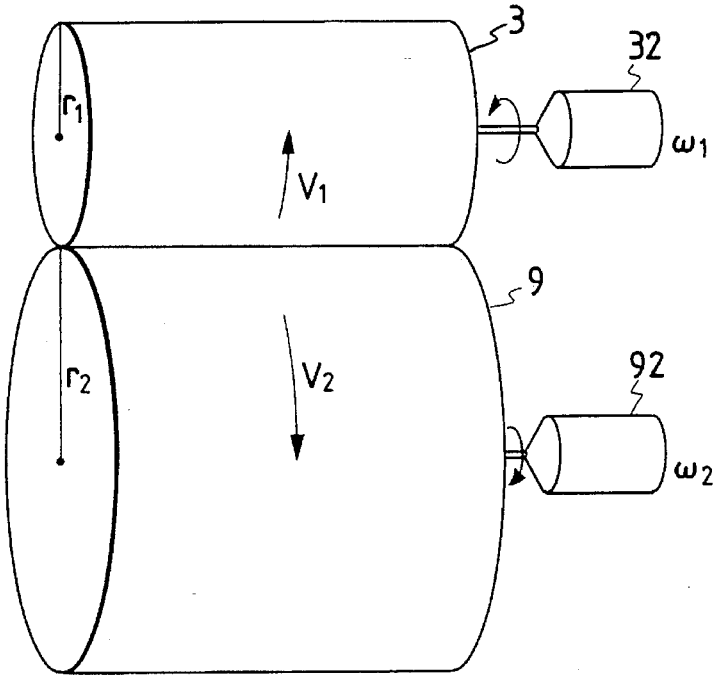
FIG. 2 is a schematic perspective view of a drive apparatus for a photosensitive drum and a transfer drum of the color image forming apparatus of FIG. 1.

FIG. 2 is a schematic perspective view for schematically showing a drive system for the photosensitive drum 3 and the transfer drum 9 of the color image forming apparatus of FIG. 1. The photosensitive drum 3 is rotated in a direction shown by the arrow by a photosensitive drum driving motor 32. Further, the transfer drum 9 is rotated in a direction shown by the arrow by a transfer drum driving motor 92. In the illustrated embodiment, the following relations were established:

$r_1$=40.0 mm;

$V_1$=160.0 mm/sec;

$\omega_1$=4π rad/sec;

$r_2$=80.0 mm;

$V_2$=162.4 mm/sec;

$\omega_2$=2.03π rad/sec;

Incidentally, as mentioned above, $r_1$ is a radius of the photosensitive drum 3, $V_1$ is a peripheral speed of the photosensitive drum, $\omega_1$ is an angular velocity of the photosensitive drum, $r_2$ is a radius of the transfer drum 9, $V_2$ is a peripheral speed of the transfer drum, and $\omega_2$ is an angular velocity of the transfer drum. That is to say, in the illustrated embodiment, the transfer drum 9 is rotated at a speed faster than that of the photosensitive drum 3 by 1.5%.

On the other hand, if the toner image on the photosensitive drum is transferred onto the recording material in this condition, the transferred image on the recording material will be longer (in the moving direction of the recording material) than the image of the original by 1.5%. To avoid this, in the illustrated embodiment, a reading speed for the original is made faster by 1.5%.

Figure 7D:
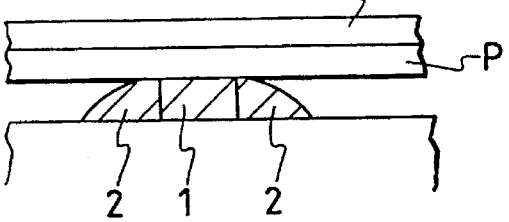
FIG. 7D PRIOR ART
FIGS. 7A to 7E are views for explaining the occurrence of a void phenomenon during the transferring of an image.
Figure 7E:
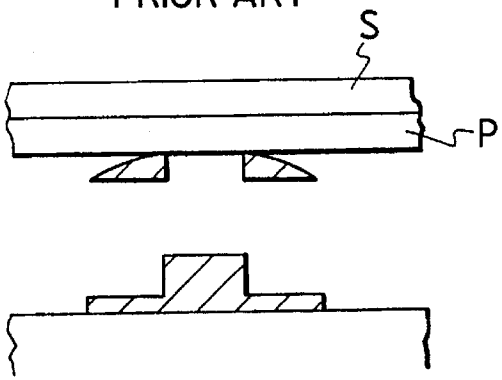
FIG. 7E PRIOR ART
Figure 7B:
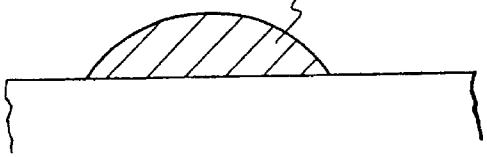
FIG. 7B PRIOR ART
Figure 7C:
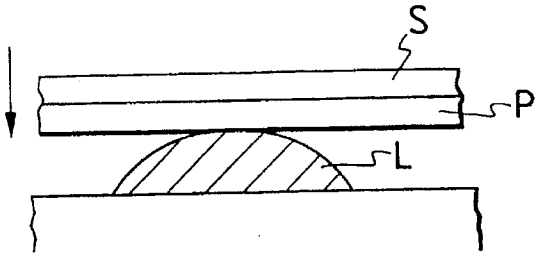
FIG. 7C PRIOR ART
Figure 7A:
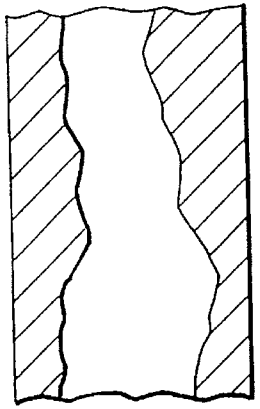
FIG. 7A PRIOR ART

When the speed of the transfer drum 9 is faster than that of the photosensitive drum 3, these drums are rotated with relative slip. Thus, the pressure acting on the toner image L in the direction shown by the arrow in FIG. 7C is reduced so that the central portion 1 and the both side portions (edge portions) 2 of the toner image L are pressurized uniformly, with the result that the toner in the central portion 1 of the toner image L is prevented from remaining on the surface of the photosensitive drum.

In this way, according to the present invention, the void phenomenon wherein only the edge portions of the toner line image are transferred and the central portion of the toner line image is not transferred can be prevented from occurring, thereby obtaining an output image with high quality without fail.

In the first embodiment, while the speed of the transfer drum was faster than that of the photosensitive drum, there may be a relative speed difference between the photosensitive drum and the transfer drum, and, accordingly, the speed of the photosensitive drum may be faster than that of the transfer drum. However, since the length (in the moving direction of the recording material) of the output image is varied in accordance with the speed of the transfer drum, it is necessary to adjust the reading speed for the original in accordance with the peripheral speed of the transfer drum.

Next, a second embodiment of the present invention will be explained with reference to FIG. 3.

Figure 3:
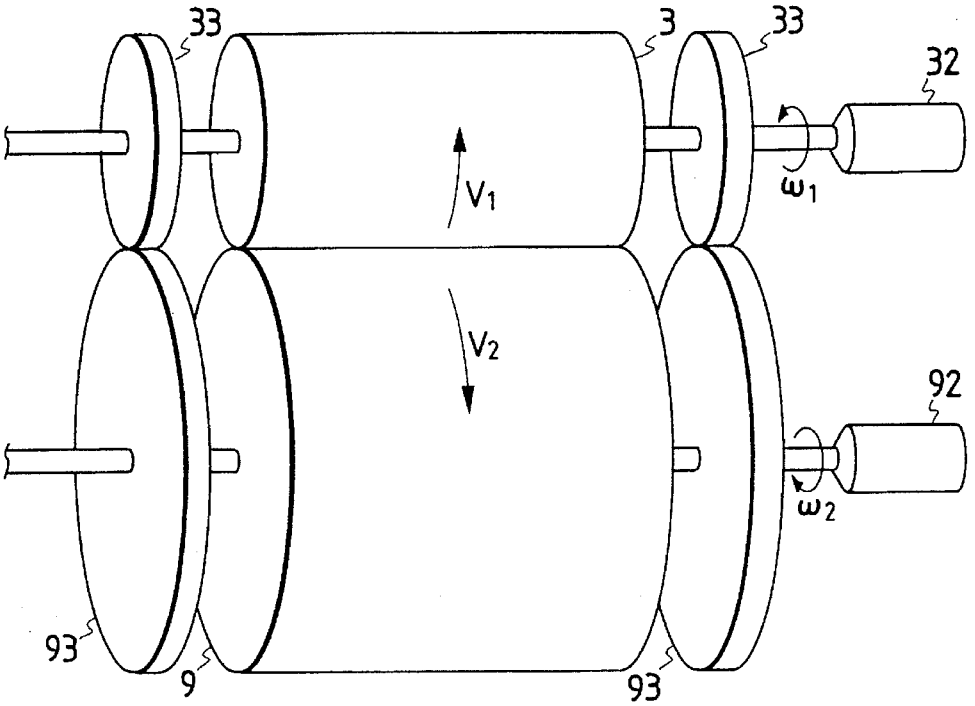
FIG. 3 is a schematic perspective view of a drive apparatus for a photosensitive drum and a transfer drum according to a second embodiment.

FIG. 3 is a schematic perspective view showing a main portion of the second embodiment of the present invention, wherein a drive system for a photosensitive drum 3 and a transfer drum 9 in a color image forming apparatus of electrophotographic type using a single photosensitive drum.

Also in this second embodiment, the photosensitive drum 3 is rotated in a direction shown by the arrow at a peripheral speed of $V_1$ by a photosensitive drum driving motor 32 and the transfer drum 9 is rotated in a direction shown by the arrow at a peripheral speed of $V_2$ by a transfer drum driving motor 92. The relations in this case are the same as those in the first embodiment. That is, when a radius of the photosensitive drum 3 is $r_1$, an angular velocity of the photosensitive drum is $\omega_1$, a radius of the transfer drum 9 is $r_2$ and an angular velocity of the transfer drum is $\omega_2$:

$r_1$=40.0 mm;

$V_1$=160.0 mm/sec;

$\omega_1=4\pi$ rad/sec;

$r_2$=80.0 mm;

$V_2$=162.4 mm/sec;

$\omega_2=2.03\pi$ rad/sec.

In this embodiment, the photosensitive drum 3 and the transfer drum 9 are positioned by abutting a pair of photosensitive drum rollers 33 rotatably mounted on a drum shaft on both sides of the photosensitive drum against a pair of transfer drum rollers 93 rotatably mounted on a drum shaft on both sides of the transfer drum. In this case, when the rollers 33 are abutted against the rollers 93, a gap of about 50 μm is created between the photosensitive drum 3 and the transfer drum 9. That is to say, when the recording material is wound around the transfer drum 9, the recording material is contacted with the photosensitive drum. Incidentally, the rollers 33, 93 can be freely rotated with respect to the respective drum shafts.

According to this embodiment, even when the photosensitive drum 3 and the transfer drum 9 are rotated while being abutted against with each other at different speeds, since the photosensitive drum 3 and the transfer drum 9 are positioned by abutting the photosensitive drum rollers 33 against the transfer drum rollers 93, the excessive torque variation does not act on the photosensitive drum driving motor 32 and the transfer drum driving motor 92. Thus, it is possible to achieve the constant speed rotation more stable than the first embodiment. Of course, also in this embodiment, the void phenomenon wherein only the edge portions of the toner line image are transferred and the central portion of the image is not transferred can be prevented from occurring, thereby obtaining the high quality image without fail.

In the first and second embodiments, while the peripheral speeds of the photosensitive drum and the transfer drum were set by adjusting the rotational angular velocity of each driving source by means of the independent drive systems, one of the photosensitive drum and the transfer drum may be driven and the peripheral speeds of the photosensitive drum and the transfer drum may be set by adjusting the pulley ratio or the gear ratio.

Figure 4:
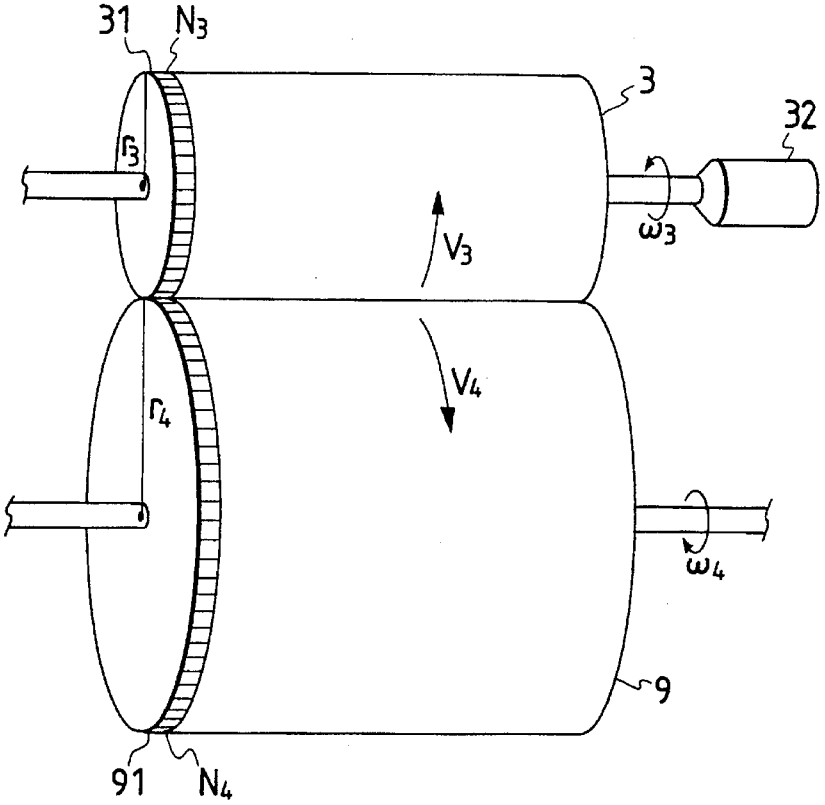
FIG. 4 is a schematic perspective view of a drive apparatus for a photosensitive drum and a transfer drum according to a third embodiment.

FIG. 4 is a schematic perspective view for schematically showing a drive system for a photosensitive drum and a transfer drum according to a third embodiment wherein the peripheral speeds of the photosensitive drum and the transfer drum are set by adjusting the gear ratio. This embodiment also shows an example that the present invention is applied to a color image forming apparatus of electrophotographic type using a single photosensitive drum as shown in FIG. 1. The photosensitive drum 3 is rotated in a direction shown by the arrow at an angular velocity of $\omega_3$ by a driving motor 32 so that a peripheral speed of $V_3$ can be attained. Further, the transfer drum 9 is rotated in a direction shown by the arrow at an angular velocity of $\omega_4$ by transmitting the rotational force of the photosensitive drum 3 to the transfer drum via a gear 91 meshed with a gear 31 of the photosensitive drum 3. In this case, a peripheral speed of the transfer drum 9 is $V_4$. Now, it is assumed that a radius of the photosensitive drum 3 is $r_3$, the number of teeth of the photosensitive drum gear 31 is $N_3$, a pitch circle of this gear is $D_3$, a radius of the transfer drum 9 is $r_4$, the number of teeth of the transfer drum gear 91 is $N_4$ and a pitch circle of this gear is $D_4$.

In this embodiment, the numerical relations as mentioned above between the photosensitive drum 3 and the transfer drum 9 are selected as follows:

$$\omega_3=1/k\cdot\omega_4(k=\ldots,\ 1/4,\ 1/3,\ 1/2,\ 1,\ 2,\ 3,\ 4,\ \ldots);$$

$$N_3=k\cdot N_4;$$

$$D_3=k\cdot D_2;$$

and $$r_4=\alpha\cdot 1/k\cdot r_3\ (\alpha\neq 1).$$

In this case, the relation between the peripheral speeds becomes as follows:

$$V_3=\alpha\cdot V_4.$$

In the illustrated embodiment, since the gear ratio k between the photosensitive drum 3 and the transfer drum 9 shown in FIG. 4 is ½, when $\alpha$=1.015, the following values are established:

$r_3$=40.0 mm;

$\omega_3=4\pi$ rad/sec;

$N_3$=80;

$D_3$=40.0 mm;

$V_3$=160 mm/sec;

$r_4$=81.2 mm;

$\omega_4=2\pi$ rad/sec;

$N_4$=160;

$D_4$=80.0 mm;

$V_4$=162.4 mm/sec.

Briefly speaking, the photosensitive drum 3 and the transfer drum 9 are rotated at the angular velocity ratio depending upon the gear ratio so that the peripheral surface of the transfer drum 9 is rotated at the peripheral speed faster than that of the peripheral surface of the photosensitive drum 3 by 2.4 mm/sec (i.e., at the speed faster than that of the photosensitive drum 3 by $\alpha$ times). That is to say, these drums are rotated with the relative slip. Thus, as mentioned above, the central portion and the both side portions of the toner line image L formed on the photosensitive drum 3 are pressurized substantially uniformly, with the result that the toner in the central portion of the toner image is prevented from remaining on the surface of the photosensitive drum. Accordingly, also in this embodiment, it is possible to prevent the occurrence of the void phenomenon wherein only the edge portions of the toner line image are transferred and the central portion of the image is not transferred, thereby obtaining the output image with high quality without fail.

Further, since the number of teeth of the photosensitive drum gear 31 is greater than that of the transfer drum gear 91 by integral number times or vice versa, particularly in the output of the full-color image, the toner images of different colors transferred to a certain portion of the recording material are formed on a corresponding given portion of the photosensitive drum. Thus, even if there are eccentricity and/or rotational unevenness of the photosensitive drum and the transfer drum, it is advantageous in the point that the good image having no color discrepancy can be outputted.

Incidentally, also in this embodiment, since the image transferred to the recording material becomes longer than the image formed on the photosensitive drum 3 by 1.5% (in the moving direction of the recording material), the speed of the laser exposure and the reading speed for the original must be faster by 1.5%.

Figure 5A:
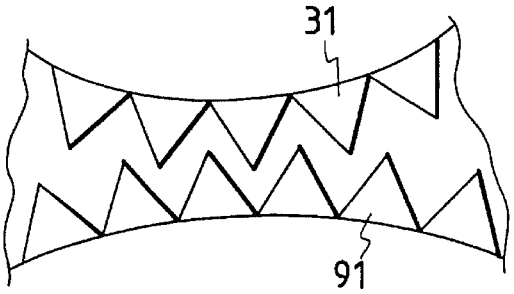
FIGS. 5A and 5B are schematic views for showing a meshing condition between gears of the photosensitive drum and of the transfer drum of FIG. 4.

According to the third embodiment of the present invention, as shown in FIG. 5A, the photosensitive drum gear 31 is meshed with the transfer drum gear 91 with any play so that they are spaced apart from each other by $\Delta d$ $(=(\alpha-1)1/k\cdot r_3)$.

Figure 5B:
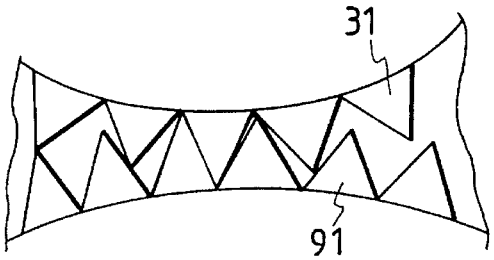
Figure 6:
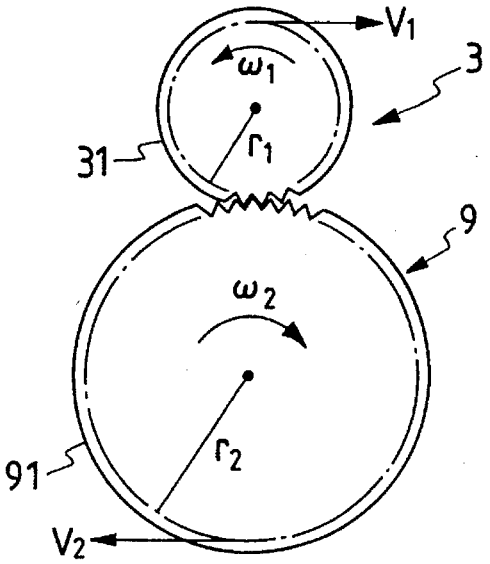
FIG. 6 PRIOR ART
FIG. 6 is a schematic view for showing a driving condition between a photosensitive drum and a transfer drum in a conventional image forming apparatus.

In this spaced relation, as the driving force is transmitted from the photosensitive drum gear 31 to the transfer drum gear 91, particularly when the gears are made of resin such as Delrin, it is feared that tips of teeth of the gears are worn. To avoid this, the gears must be frofile-shifted; that is, in this case, the pitch circle of the transfer drum gear 91 must be increased so that the photosensitive drum gear 31 can be meshed with the transfer drum gear 91 without any play as shown in FIG. 5B.

However, also in this case, the following relation must be maintained:

$$N_3=k\cdot N_4(k=\ldots, 1/4, 1/3, 1/2, 1, 2, 3, 4, \ldots).$$

Speaking as to the apparatus according to the third embodiment shown in FIG. 4, the following relations may be satisfied:

$D_3$=80.00 mm; and $D_4$=162.4 mm.

Further, by making radius $r_3$ of the photosensitive drum 3 smaller than the radius $D_3$ of the pitch circle thereof and by making the radius $r_4$ of the transfer drum 4 greater than the radius $D_4$ of the pitch circle thereof, it is possible to differentiate the peripheral speed $V_3$ of the photosensitive drum 3 from the peripheral speed $V_4$ of the transfer drum 9. As an example regarding FIG. 4, the following relations are established:

$r_3$=39.5 mm;

$\omega_3=4\pi$ rad/sec;

$N_3$=80;

$D_3$=40.0 mm;

$V_3$=158.0 mm/sec;

$r_4$=80.5 mm;

$\omega_4=2\pi$ rad/sec;

$N_4$=160;

$D_4$=80.0 mm;

$V_4$=161.0 mm/sec.

Also in this case, although the photosensitive drum 3 and the transfer drum 9 are rotated at the angular velocity ratio depending upon the gear ratio, the peripheral surface of the transfer drum 9 is rotated at the peripheral speed faster than that of the peripheral surface of the photosensitive drum 3 by 3.0 mm/sec. Further, since there is the relation $((D_3-r_3)=(r_4-D_4))$, the photosensitive drum 3 and the transfer drum 9 are completely engaged with each other (without any play), with the result that the wear can be reduced in comparison with the conventional case.

In the above-mentioned first to third embodiments, while an example that the present invention is applied to the color image forming apparatus of electrophotographic type using the single photosensitive drum as shown in FIG. 1 was explained, the present invention is not limited to this example. That is, the present invention can easily be applied to a color image forming apparatus wherein a plurality of image forming portions each including an exclusive photosensitive drum as an image bearing member are arranged side by side and toner images having different colors are formed on the respective photosensitive drum and the toner images are successively transferred onto a recording material carried and conveyed by a recording material bearing means in a superimposed fashion and the transferred toner images are fixed together to obtain a color image. Next, a fourth embodiment of the present invention wherein the present invention is applied to such a color image forming apparatus of electrophotographic type will be explained with reference to FIG. 8.

Figure 8:
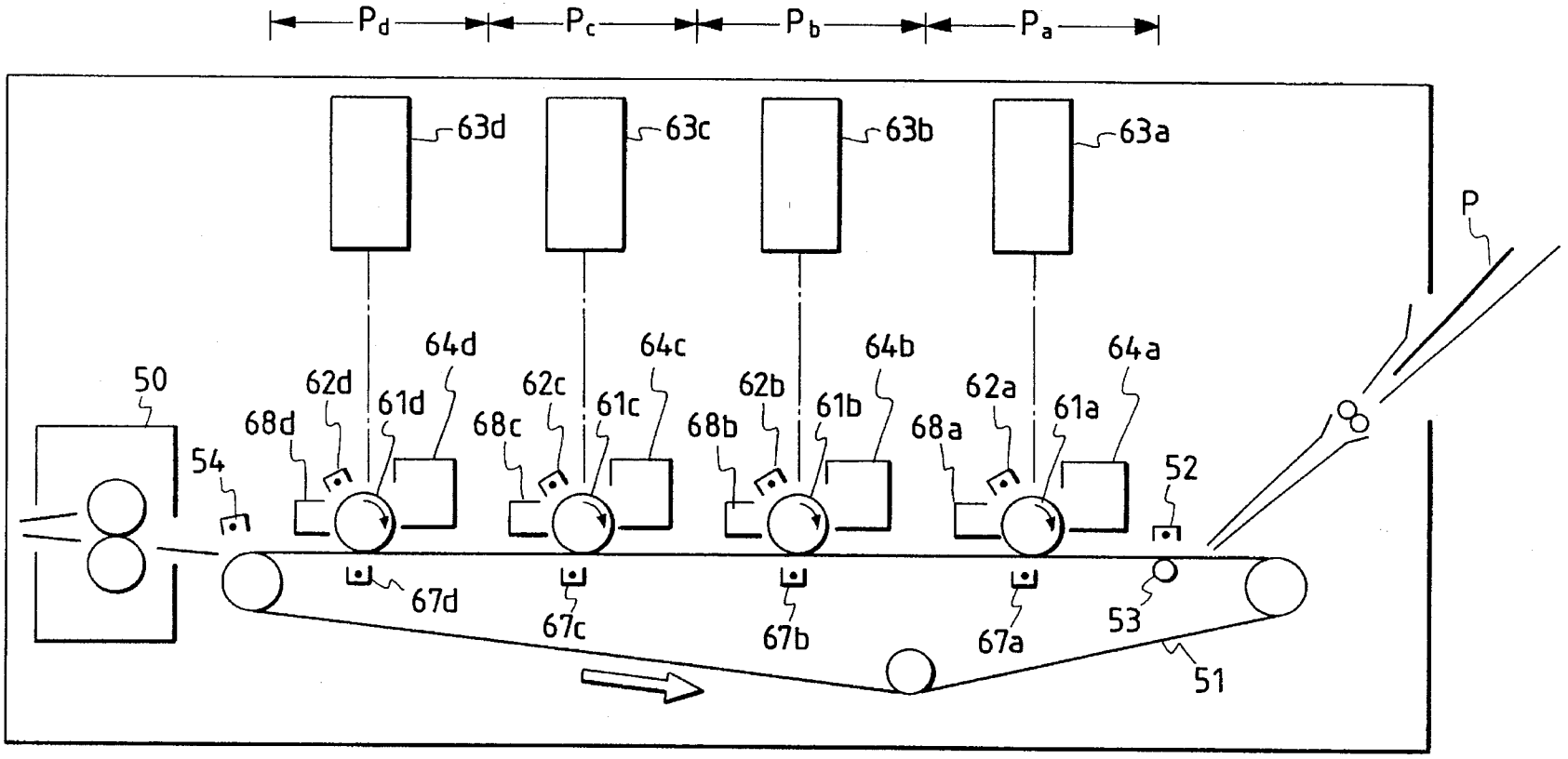
FIG. 8 is a schematic sectional view showing a whole construction of a color image forming apparatus of electrophotographic type according to a second embodiment of the present invention.

FIG. 8 shows the whole construction of a color image forming apparatus of electrophotographic type to which the present invention is applied. The color image forming apparatus comprises a body frame within which first, second, third and fourth image forming portions Pa, Pb, Pc and Pd are arranged. A sheet supply portion is arranged at the right side (FIG. 8) of the body frame and a fixing device 50 is arranged at the left side (FIG. 8) of the body frame. Further, within the body frame, below a recording material moving path extending from the sheet supply portion to the fixing device 50, an endless recording material bearing means (for example, recording material bearing belt) 51 for carrying and conveying a recording material is mounted around end tensioned between a plurality of rollers in a known manner. The recording material bearing belt 51 is driven in a direction shown by the arrow in FIG. 8 so that the belt can receive the recording material P supplied from the sheet supply portion and successively convey the recording material through the image forming portions Pa, Pb, Pc and Pd.

The image forming portions Pa, Pb, Pc and Pd have substantially the same construction. That is, as is usual, the image forming portions Pa, Pb, Pc and Pd include electrophotographic photosensitive drums (image bearing members) 61*a*, 61*b*, 61*c* and 61*d* which are rotated in directions shown by the arrows, and image forming means are arranged around the respective photosensitive drums. The image forming means may be of appropriate type; but, in the illustrated embodiment, they comprise chargers 62*a*, 62*b*, 62*c* and 62*d* for uniformly charging the respective photosensitive drums, developing devices 64*a*, 64*b*, 64*c* and 64*d* for developing electrostatic latent images formed on the respective photosensitive drums, transfer chargers 67*a*, 67*b*, 67*c* and 67*d* for transferring developed visualized images (toner images) onto the recording material P, and cleaners 68*a*, 68*b*, 68*c* and 68*d* for removing the toner remaining on the respective photosensitive drums. The charger, developing device, transfer charger and cleaner are arranged around the corresponding photosensitive drum in order along the rotational direction of the drum. Further, above the photosensitive drums 61*a*, 61*b*, 61*c* and 61*d*, there are disposed image exposure devices 63*a*, 63*b*, 63*c* and 63*d*, respectively.

The developing device 64*a* contains black toner, the developing device; 64*b* contains yellow toner, the developing device 64*c* contains magenta toner, and the developing device 64*d* contains cyan toner. In the illustrated embodiment, each of the image exposure devices 63*a*, 63*b*, 63*c* and 63*d* comprises a semiconductor laser, a polygon mirror, an Fθ lens and the like and is designed so that the electrostatic latent image is formed on the corresponding photosensitive drum 61*a*, 61*b*, 61*c* or 61*d* by exposing the drum surface by scanning a laser beam modulated by an electric digital image pixcel signal in the generatrix direction of the photosensitive drum between the charger 62*a*, 62*b*, 62*c* or 62*d* and the developing device 64*a*, 64*b*, 64*c* or 64*d*. The image pixcel signal corresponding to the black image component is inputted to the image exposure device 63*a*, the image pixcel signal corresponding to the yellow image component is inputted to the image exposure device 63*b*, the image pixcel signal corresponding to the magenta image component is inputted to the image exposure device 63*c*, and the image pixcel signal corresponding to the cyan image component is inputted to the image exposure device 63*d*. Further, a recording material adsorption means comprising an adsorption charger 52 and an auxiliary adsorption roller (count-electrode) 53 is disposed between the first image forming portion Pa and the sheet supply portion, so that the recording material P supplied from the sheet supply portion is surely adhered to the recording material bearing belt 51. On the other hand, a charge removing charger 54 is disposed between the fourth image forming portion Pd and the fixing device 50, and an AC voltage is applied to the charge removing charger 54 to separate the recording material P from the recording material bearing belt 51 to which the recording material is adhered.

The recording material bearing belt 51 is formed from a film sheet made of dielectric resin such as polyurethane resin, polyvinylidene fluoride resin, polyethylene terephtalate resin, polycarbonate resin, polyether sulfonic resin or the like, and is rotated in a direction shown by the arrow in FIG. 8 at a constant speed (for example, 100 mm/sec).

In the color image forming apparatus having the above-mentioned construction, when the recording material P is supplied onto the recording material bearing belt 51 while being guided by the sheet supply guides, the recording material P is electrostatically adhered to the recording material bearing belt 51 surely by the action of the recording material adsorption means. As the recording material bearing belt 51 is shifted in the direction shown by the arrow in FIG. 8, the black visualized image is formed on the photosensitive drum 61*a* of the first image forming portion Pa, the yellow visualized image is formed on the photosensitive drum 6l*b* of the second image forming portion Pb, the magenta visualized image is formed on the photosensitive drum 61*c* of the third image forming portion Pc, and the cyan visualized image is formed on the photosensitive drum 61*d* of the fourth image forming portion Pd. As the recording material P is passed below the photosensitive drums 61*a* to 61*d* of the first to fourth image forming portions Pa to Pd successively by the movement of the recording material bearing belt 51, these visualized images are transferred onto the recording material P successively in a superimposed fashion by the transfer chargers (corona dischargers) 67*a*, 67*b*, 67*c* and 67*d* of the respective image forming portions, thereby forming a color image. After the recording material P passes through the fourth image forming portion Pd, the charge on the recording material is removed by the charge removing charger 54 (to which the AC voltage is applied), with the result that the recording material is separated from the recording material bearing belt 51. The recording material P separated from the recording material bearing belt 51 is sent to the fixing device 50, where the superimposed images are fixed to the recording material. Thereafter, the recording material is discharged out of the apparatus through a discharge opening (not shown). In this way, one copying cycle is completed.

In this color image forming apparatus according to this embodiment, peripheral speeds Vd of the photosensitive drums 61*a* to 61*d* and a moving speed Vt of the recording material bearing belt 51 were selected, respectively, as follows:

Vd=100 mm/sec; and

Vt=102 mm/sec.

With this arrangement, the recording material bearing belt 51 is shifted faster than the photosensitive drums 61*a* to 61*d* by 2%. Thus, the recording material bearing belt 51 and the photosensitive drums 61*a* to 61*d* are rotated with the relative slip. Accordingly, as mentioned above, it is possible to prevent the occurrence of the void phenomenon wherein only the edge portions of the toner line image are transferred and the central portion of the image is not transferred, thereby obtaining the high quality output image without fail.

Incidentally, also in this embodiment, since the image formed on the recording material becomes longer (in the moving direction of the recording material) than the image formed on the photosensitive drum by 2%, the speed of the laser exposure and the reading speed for the original must be increased by 2%.

Further, in this embodiment, while the moving speed of the recording material bearing belt was faster than the peripheral speed of each photosensitive drum, there may be a relative speed difference between each photosensitive drum and the recording material bearing belt. However, since the length (in the moving direction of the recording material) of the output image is varied in accordance with the moving speed of the recording material bearing belt, it is necessary to adjust the speed of the laser exposure and the reading speed for the original in accordance with the speed of the recording material bearing belt.

In the illustrated embodiments, while there was provided the relative speed difference of about 1% or therearound between the photosensitive drum(s) and the transfer drum or the recording material bearing belt, it was found from the tests that the relative speed difference of 0.5 to 4.0% is optimum. If the relative speed difference is smaller than 0.5%, the effect will be insufficient; whereas, if the relative speed difference is greater than 4.0%, since the sliding friction between recording material and the toner image becomes greater, it is feared that the scattering of the toner and/or the damage of the photosensitive drum occur.

Further, regarding the relation between the diameters of the drums and the diameters of the pitch circles of the drum gears, since the drums and the gears are normally designed in consideration of the dispersion in the manufacture accuracy, the diameters of the pitch circles are normally made smaller than the normal ones by about 0.1 to 0.2%. In the specification, regarding the relation such as $r_1=D_1$ and the like, such error in the manufacture is neglected.

Incidentally, in the above embodiments, while examples that the present invention is applied to the color image forming apparatus of electrophotographic type were explained, it should be noted that the present invention is not limited to such examples, but may be applied to various color image forming apparatuses of other types or image forming apparatuses wherein mono-color (black and white) toner images are superimposed or image forming apparatuses of electrostatic recording type.

Figure 9:
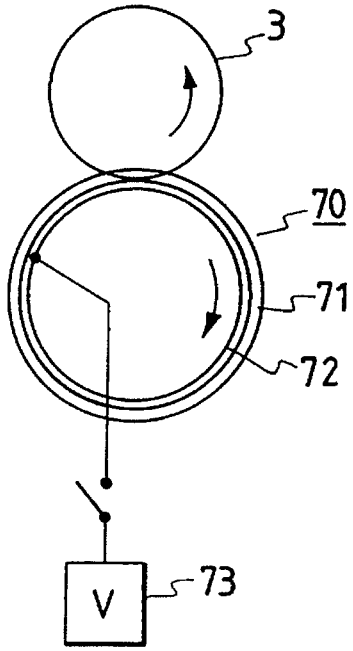
FIG. 9 is a schematic view of the apparatus, showing an alteration of an image bearing member.

Further, as an alteration of the above embodiment, there is an image forming apparatus using a transfer drum having a surface-shaped electrode as shown in FIG. 9. In this apparatus, color toner images successively formed on a photosensitive drum 3 as in the aforementioned embodiment are successively transferred onto a recording material electrostatically adhered to a transfer drum 70. Such transfer method is described in U.S. Ser. No. 832,311 (filed on Feb. 7, 1992). The transfer drum 70 has at least a dielectric layer 71 as a surface layer, and a conductive layer 72 to which a bias voltage for the transferring and adsorption is applied. The bias voltage from a power source 73 is applied to the conductive layer in synchronous with the adsorption of the recording material and the transferring of the recording material.

This transfer method has the advantages that the corona discharger for the transferring of the recording material is not required to arrange within the transfer drum 70 and that a high voltage power source is not required because of no corona discharger.

In comparison with the transfer drum comprising the cylinder having the opening and the resin sheet covering such opening according to the above-mentioned first embodiment, although the transfer drum 70 increases the urging force for urging the recording material against the photosensitive drum and the deformation of the recording material supporting surface, by applying the present invention, it is possible to prevent the occurrence of the void phenomenon during the superimposition of the toner images.

Figure 10:
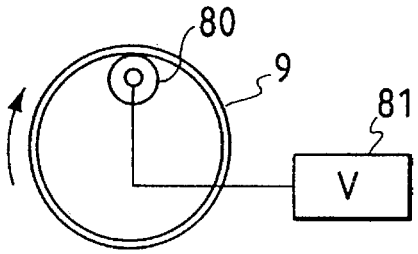
FIGS. 10 and 11 are schematic views for showing other alterations of a transfer means.
Figure 11:
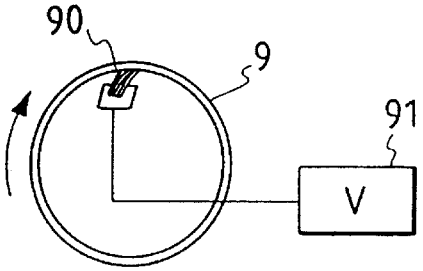

Further, in the first embodiment, while the corona discharger was used as the transfer means, in place of the corona discharger, as shown in FIG. 10, a conductive roller 80 to which the transfer bias 81 can be applied may be used, or, as shown in FIG. 1, a conductive brush 90 to which the transfer bias 91 can be applied may be used.

Furthermore, in the above embodiments, while the relative speed difference between the image bearing member and the recording material bearing means was 0.5 to 4.0%, preferably, such difference is 0.5 to 1.5% in consideration of the discrepancy in images.

As mentioned above, according to the image forming apparatus of the present invention, since there is provided the slight speed difference between the image bearing member and the recording material bearing means, the image bearing member and the recording material bearing means are rotated or shifted with the relative slip, with the result that the central portion and the edge portions of the toner line image are pressurized substantially uniformly, thereby preventing the toner in the central portion from remaining on the photosensitive drum. In this way, it is possible to prevent the occurrence of the void phenomenon wherein only the edge portions of the toner line image are transferred and the central portion of the image remains on the image bearing member, thereby achieving the high color reproductivity and obtaining the high quality output image without fail.

What is claimed is:

1. A color image forming apparatus for forming a color image by superimposing a plurality of color toner images on a recording material, comprising:

toner image forming means for forming the color toner images on an image bearing member moving endlessly;

transfer material bearing means moving endlessly by supporting the recording material to convey it to a transfer station of said image bearing member;

transfer means for transferring the toner image onto the recording material supported by said transfer material conveying means formed on said image bearing member at the transfer position; and drive means having a drive system which slightly differentiates a moving speed of said image bearing member from a moving speed of said transfer material bearing means at said transfer station, wherein said drive system comprises a drive source constituted by a first gear of said image bearing member and a second gear of said transfer material bearing means having the same pitch as the first gear, and the speed difference between said image bearing member and said transfer material bearing means is created by substantially differentiating a peripheral length of said image bearing member from that of said transfer material bearing means.

2. A color image forming apparatus according to claim 1, wherein there is provided a plurality of image bearing members, and a single transfer material bearing means successively conveys the recording material to the transfer station of each of said plural image bearing members.

3. A color image forming apparatus according to claim 2, wherein said transfer material bearing means comprises a belt which moves endlessly.

4. A color image forming apparatus according to claim 1, wherein said transfer means further comprises a transfer bias applying means fixed with respect to said image bearing member via said transfer material bearing means.

5. A color image forming apparatus according to claim 4, wherein said transfer bias applying means is a corona discharge electrode.

6. A color image forming apparatus according to claim 4, wherein said transfer bias applying means is an electrode member for urging said transfer material bearing means against said image bearing member.

7. A color image forming apparatus according to claim 1, wherein said transfer means is a surface-shaped electrode means arranged in correspondence to a transfer material supporting surface of said transfer material bearing means to form a part thereof.

8. A color image forming apparatus according to claim 1, wherein said image bearing member moving endlessly is an intermediate transfer member onto which the color toner images formed on an electrophotographic photosensitive member are successively transferred.

9. A color image forming apparatus for forming a color image by superimposing a plurality of color toner images on a recording material, comprising:

toner image forming means for forming the color toner images on an image bearing member moving endlessly;

transfer material bearing means moving endlessly by supporting the recording material to convey it to a transfer station of said image bearing member;

transfer means for transferring the toner image onto the recording material supported by said transfer material conveying means formed on said image bearing member at the transfer position; and drive means having a drive system which slightly differentiates a moving speed of said image bearing member from a moving speed of said transfer material bearing means at said transfer station, wherein in order to slightly differentiate the moving speeds, when a rotational angular velocity of said image bearing member is $\omega_1$, a peripheral speed of said image bearing member is $V_1$, a rotational angular velocity of said transfer material bearing means is $\omega_2$ and a peripheral speed of said transfer material bearing means is $V_2$, the following relation is established $$\omega_1=1/k\omega_2(k=\ldots, 1/4, 1/3, 1/2, 1, 2, 3, 4, \ldots)$$

and the peripheral speeds $V_1$ and $V_2$ are differentiated slightly from each other.

10. A color image forming apparatus according to claim 9, wherein the difference in the moving speed is 0.5 to 4.0%.

11. A color image forming apparatus according to claim 9, wherein said image bearing member is an electrophotographic photosensitive member on which yellow toner image, magenta toner image and cyan toner image are formed, thereby forming full-color image on the recording material.

12. A color image forming apparatus according to claim 9, wherein said toner image forming means extends or shrinks the toner image to be formed on said image bearing member in the moving direction of said image bearing member so that length of the toner image transferred onto the recording material to be born on said transfer material bearing member in the moving direction of said transfer material bearing means becomes equal to initial image information.

13. A color image forming apparatus for forming a color image by superimposing a plurality of color toner images on a recording material, comprising:

toner image forming means for forming the toner color images on an image bearing member moving endlessly;

transfer material bearing means moving endlessly by supporting the recording material to convey it to a transfer station of said image bearing member;

transfer means for transferring the toner image onto the recording material supported by said transfer material conveying means formed on said image bearing member at the transfer position; and a drive system comprising a first drive gear of said image bearing member and a second drive gear of said transfer material bearing means meshed with the first gear;

wherein when a radius of said image bearing member is $r_1$, a radius of a pitch circle of said first drive gear of said image bearing member is $D_1$, the number of teeth of said first drive gear is $N_1$, a radius of said transfer material bearing means is $r_2$, a radius of a pitch circle of said second drive gear of said transfer material bearing means is $D_2$ and the number of teeth of the second drive gear is $N_2$, the following relation is established:

$$N_1=kN_2(k=\ldots, 1/4, 1/3, 1/2, 1, 2, 3, 4, \ldots)$$

and a moving speed of said image bearing member is slightly differentiated from that of transfer material bearing means by equalizing radius $r_1$ and $D_1$ and differentiating radius $r_2$ and $D_2$ or by equalizing radius $r_2$ and $D_2$ and differentiating radius $r_1$ and $D_1$.

14. A color image forming apparatus according to claim 13, wherein the difference in the moving speed is 0.5 to 4.0%.

15. A color image forming apparatus according to claim 13, wherein said image bearing member is an electrophotographic photosensitive member on which yellow toner image, magenta toner image and cyan toner image are formed, thereby forming full-color image on the recording material.

16. A multiple image forming apparatus for forming a multiple image by superimposing a plurality of images on a transfer material, comprising:

image bearing means for bearing an image thereon;

a transfer material bearing member for bearing the transfer material, the image born on said image bearing means being superimposedly transferred sequentially to the transfer material born on said transfer material bearing member at a transfer position;

absorbing means for absorbing the transfer material to said transfer material bearing member prior to start of the image transferring to the transfer material; and drive means for driving said image bearing means and said transfer material bearing member so that, when the image born on said image bearing means is transferred onto the transfer material, a moving speed of said image bearing means at the transfer position differs from a moving speed of said transfer material bearing member at the transfer position, wherein during a time when the image born on said image bearing means is transferred onto the transfer material born on said transfer material bearing member, the transfer material and said transfer material bearing member move at the same speed while said image bearing means and said transfer material bearing member move at the different speeds.

17. A multiple image forming apparatus according to claim 16, wherein said image bearing means and said transfer material bearing member have drum-like configuration, said drive means drives said image bearing means and said transfer material bearing means so that values of $r_1/r_2$ and $w_2/w_1$ are different from each other, provided that a radius of said image bearing means at the transfer position is $r_1$, a rotational angular velocity of said image bearing member is $w_1$, and a radius of said transfer material bearing member at the transfer position is $r_2$, a rotational angular velocity, of said transfer material bearing member is $w_2$.

18. A multiple image forming apparatus according to claim 16, wherein said image bearing means has a plurality of image bearing members.

19. A multiple image forming apparatus according to claim 16, wherein between the moving speed of said image bearing means and that of said transfer material bearing member at the transfer position, there exists a speed difference of 0.5–4.0%.

20. A multiple image forming apparatus according to claim 16, wherein said transfer material bearing member includes a cylinder having an opened portion, and a sheet portion spanned thereat.

21. A multiple image forming apparatus for forming a multiple image onto the recording material, wherein a radius of said image by superimposing a plurality of images on a transfer material, comprising:

image bearing means for bearing an image thereon, said image bearing means having a drum-like configuration;

a transfer material bearing member for bearing the transfer material, said transfer material bearing member having a drum-like configuration, the image born on said image bearing means being superimposedly transferred sequentially to the transfer material born by said transfer material bearing member at a transfer position;

drive means for driving said image bearing means and said transfer material bearing member so that values of $r_1/r_2$ and $w_2/w_1$ are different from each other when the image born on said image beeping means is transferred onto the transfer material, wherein a radius of said image bearing means at the transfer position is $r_1$, a rotational angular velocity of said image bearing means is $w_1$, a radius of said transfer material bearing member at the transfer position is $r_2$, and a rotational angular velocity of said transfer material bearing member is $w_2$, a value of $r_1/r_2$ is k (k=. . . 1/4, 1/3, 1/2, 1, 2, 3, 4, . . . ).

22. A multiple image forming apparatus according to claim 21, wherein said drive means has a first drive source for driving said image bearing means and second drive source for driving said transfer bearing member.

23. A multiple image forming apparatus according to claim 21, wherein between the moving speed of said image bearing means and that of said transfer material bearing member at the transfer position, there exists a speed difference of 0.5–4.0%.

24. A multiple image forming apparatus according to claim 21, wherein said transfer material bearing member includes a cylinder having an opened portion, and a sheet portion spanned thereat.

25. A multiple image forming apparatus for forming a multiple image by superimposing a plurality of images on a transfer material, comprising:

image bearing means for bearing an image thereon, said image bearing means having a drum-like configuration;

a transfer material bearing member for bearing the transfer material thereon, said transfer material bearing member having a drum-like configuration, the image born on said image bearing means being superimposedly transferred sequentially to the transfer material born on said transfer material bearing member at a transfer position; and drive means for driving said image bearing means and said transfer material bearing member so that values of $r_1/r_2$ and $w_2/w_1$ are different from each other when the image born on said image bearing means is transferred onto the recording material, wherein a radius of said image bearing means at the transfer position is $r_1$, a rotational angular velocity of said image bearing means is $w_1$, a radius of said transfer material bearing member at the transfer position is $r_2$, and a rotational angular velocity of said transfer material bearing member is $w_2$, a value of $w_2/w_1$, k (k=. . . ¼, ⅓, ½, 1, 2, 3, 4, . . . ).

26. A multiple image forming apparatus according to claim 25, wherein said drive means includes a first gear provided on a rotational shaft of said image bearing means and a second gear provided on a rotational shaft of said transfer material bearing member to be meshed with the first gear, and relation of $N_1=k\cdot N_2$ (k=. . . ¼, ⅓, ½, 1, 2, 3, 4 . . . ) is established between the number of teeth $N_1$ of the first gear and the number of teeth $N_2$ of the second gear.

27. A multiple image forming apparatus according to claim 25, wherein between the moving speed of said image bearing means and that of said transfer material bearing member at the transfer position, there exists a speed difference of 0.5–4.0%.

28. An image forming apparatus according to claim 25, wherein said transfer material bearing member includes a cylinder having an opened portion, and a sheet portion spanned thereat.

* * * * *

UNITED STATES PATENT AND TRADEMARK OFFICE

CERTIFICATE OF CORRECTION

PATENT NO. : 5,515,154
DATED : May 7, 1996
INVENTOR(S) : TAKASHI HASEGAWA, ET AL.

It is certified that error appears in the above-indentified patent and that said Letters Patent is hereby corrected as shown below:

Column 1,
line 22, "(so-colled" should read --(so-called--.
Column 4,
line 28, "to image" should read --to--.
Column 5,
line 16, "an yellow" should read --a yellow--.
Column 6,
line 64, "wherein" should read --wherein there is--.
Column 7,
line 58, "that" should read --where--.
Column 9,
line 28, "80.00 mm;" should read --80.0 mm;--; and
line 62, "that" should read --where--.
Column 10,
line 25, "around end" should read -around and--;
line 64, "pixcel" should read --pixel--; and
line 66, "pixcel" should read --pixel--.

UNITED STATES PATENT AND TRADEMARK OFFICE

CERTIFICATE OF CORRECTION

PATENT NO. : 5,515,154
DATED : May 7, 1996
INVENTOR(S) : TAKASHI HASEGAWA, ET AL.

It is certified that error appears in the above-indentified patent and that said Letters Patent is hereby corrected as shown below:

Column 11,
line 1, "pixcel" should read --pixel--;
line 3, "pixcel" should read --pixel--;
line 5, "pixcel" should read --pixel--; and
line 8, "(count-" should read --(counter- --.

Column 15,
line 5, "born" should read --borne--;
line 56, "born" should read --borne--;
line 58, "born" should read --borne--; and
line 66, "born" should read --borne--.

Column 16,
line 4, "born" should read --borne--;
line 5, "born" should read --borne--;
line 20, "velocity," should read --velocity--;
line 34, "onto the recording material, wherein a radius" should be deleted;
line 35, "of said image" should be deleted;
line 41, "born" should read --borne--;
line 43, "born" should read --borne--; and
line 48, "born" should read --borne--, and "beeping" should read --bearing--.

UNITED STATES PATENT AND TRADEMARK OFFICE

CERTIFICATE OF CORRECTION

PATENT NO. : 5,515,154

DATED : May 7, 1996

INVENTOR(S) : TAKASHI HASEGAWA, ET AL.

It is certified that error appears in the above-indentified patent and that said Letters Patent is hereby corrected as shown below:

Column 17, line 11, "born" should read --borne--;

line 13, "born" should read --borne--; and line 18, "born" should read --borne--.

Column 18, line 3, "$w_2/w_1$, k" should read --$w_2/w_1$ is k--.

Signed and Sealed this

First Day of October, 1996

Bruce Lehman

*Attest:*

BRUCE LEHMAN

*Attesting Officer*

*Commissioner of Patents and Trademarks*